US006779654B1

(12) United States Patent
Marquis

(10) Patent No.: US 6,779,654 B1
(45) Date of Patent: Aug. 24, 2004

(54) SHOTGUN SHELL BOX

(75) Inventor: Donald Richard Marquis, Cedar Glen, CA (US)

(73) Assignee: Reloader Innovations a Partnership, Blue Jay, CA (US)

( * ) Notice: Subject to any disclaimer, the term of this patent is extended or adjusted under 35 U.S.C. 154(b) by 0 days.

(21) Appl. No.: 10/066,406

(22) Filed: Jan. 31, 2002

Related U.S. Application Data

(60) Provisional application No. 60/266,563, filed on Feb. 6, 2001.

(51) Int. Cl.[7] ..... F42B 39/00; B65D 85/20; B65D 69/00

(52) U.S. Cl. ..... 206/3; 206/446; 206/223

(58) Field of Search ..... 206/3, 774, 443, 206/446, 8, 82, 223, 427, 764, 765, 776, 781; 220/796, 780, 799; 224/931; D3/297, 298, 904, 905; 53/142, 390, 392, 143, 144, 242, 243, 255, 260

(56) References Cited

U.S. PATENT DOCUMENTS

| | | | | | |
|---|---|---|---|---|---|
| 85,241 | A | * | 12/1868 | Paine | 206/3 |
| 869,310 | A | | 10/1907 | Lemly | |
| 1,455,803 | A | | 5/1923 | Nofsinger | |
| 1,546,391 | A | | 7/1925 | McCullough | |
| 1,562,114 | A | | 11/1925 | Micheli | |
| 1,571,235 | A | * | 2/1926 | Deppa | 53/255 |
| 1,782,615 | A | | 11/1930 | Hopwood | |
| 2,305,198 | A | | 12/1942 | Shonblom | |
| 2,426,484 | A | | 8/1947 | Buffenbarger | |
| 2,928,530 | A | * | 3/1960 | Sauey | 206/3 |
| 3,163,286 | A | | 12/1964 | Covington, Jr. | |
| 3,282,636 | A | | 11/1966 | Rigterink | |
| 3,390,510 | A | | 7/1968 | Crisci | |
| 3,479,796 | A | * | 11/1969 | Blunt | 206/3 |
| 4,194,657 | A | | 3/1980 | Thor | |
| 4,288,197 | A | | 9/1981 | Gurolnick | |
| 4,572,415 | A | * | 2/1986 | Fehr | 224/675 |
| 4,651,619 | A | | 3/1987 | Voecks | |
| 4,657,132 | A | * | 4/1987 | Abdo | 206/3 |
| 4,757,894 | A | | 7/1988 | Schreckenstein | |
| D329,140 | S | * | 9/1992 | Maricle | D3/225 |
| 5,450,947 | A | | 9/1995 | Sgueglia, Sr. | |

* cited by examiner

*Primary Examiner*—Gregory Pickett
*Assistant Examiner*—John Pickett
(74) *Attorney, Agent, or Firm*—Knobbe, Martens, Olson & Bear, LLP

(57) ABSTRACT

A shotgun shell housing assembly comprising a container adapted to hold stacked shells and a cover adapted to receive the container. The container is adapted to permit stacking of shells in a common configuration similar to that used for factory loaded ammunitions. To facilitate stacking of the shells, the container can be held at an angle by a removable stand. The container with stacked shells is received by the cover and retained by a latching mechanism to form an enclosed housing that stores the shells. To access the shells, the container is removed so as to transfer the shells from the container into the cover. The cover is dimensioned to fit into many products designed to hold paper cartons holding factory loaded shotgun shells. The shotgun shell housing assembly is preferably formed from a resilient material so as to permit repeated use.

35 Claims, 8 Drawing Sheets

SHOTGUN SHELL BOX

RELATED APPLICATIONS

This application claims the benefit of U.S. Provisional Application No. 60/266,563, filed on Feb. 6, 2001.

BACKGROUND OF THE INVENTION

1. Field of the Invention

The present invention relates to apparatus and method for holding shotgun shells.

2. Description of the Related Art

A shotgun shell is a self-contained ammunition adapted to be fired from a shotgun. The shell comprises a cylindrical case, typically formed from plastic, with a brass base. At the center of the circular base is a primer, and contained within the base is a powder charge. The case contains a load of shot separated from the powder charge by a wad. The end of the case opposite from the brass base is crimped so as to prevent the contents of the case from spilling out.

When the shotgun is fired, a firing pin strikes and detonates the primer causing it to ignite the powder charge. Rapidly burning powder charge causes a violent but controlled expansion of gas that forces the wad and the shot load through a barrel and out of a muzzle at the end of the barrel. After discharging the shot load, the shotgun shell comprises the empty case and the expended primer.

Shotgun shells are manufactured by a plurality of manufacturers, and can be purchased at many retail stores. Many shotgun users, however, choose to re-assemble (referred to as reloading) the shotgun shells themselves for various reasons. One reason is that reloading is substantially more economical in terms of material cost, especially when relatively large quantities are considered. Another reason is that by reloading, the reloader can customize and control the quality and performance of the shells.

To reload shotgun shells, the reloader can either assemble new components, or reuse part of the expended shell (hence the term reload). For example, the empty case of the expended shell can be reused by replacing the primer and filling the case with various components. Such reloading procedure is completed by re-crimping of the end of the shell.

Many reloaders like to organize the reloaded shells in various manners. One common method is to put the shells into a paper carton that originally held new factory loaded shells. Factory loaded shells are typically sold in quantities of 25 arranged in 5 rows of 5 shells. The box-shaped paper carton includes an opening flap that when opened, exposes the top row of 5 shells. Because of the popularity of 25-shell paper cartons, many products are dimensioned and adapted to allow use of shells directly from such cartons. One example is a shell pouch worn on the belt of a shooter dimensioned to receive the carton such that the opening flap is at the top so as to permit quick access to shells.

To facilitate packaging of reloaded shells into such paper cartons, a shell stacking device such as MEC-Stacker is commercially available to reloaders. The stacking device comprises a open faced tray permanently attached to a base, the open faced tray being oriented at an angle so as to permit shells to be stacked therein in 5×5 configuration, aided by gravity. The open faced tray is dimensioned to fit into the empty factory paper carton. Thus to fill the empty paper carton with reloaded shells, the paper carton with the opening flap open is inverted and slid over the open faced tray filled with shells. Then the paper carton and the open faced tray therein are rotated so as to position the opening flap portion of the carton at top. The stacking device is pulled upward and the shells are released from the open faced tray by gravity so as to remain inside the paper carton. The stacking device, while allowing stacking of shells and transferring of the stacked shells into the factory paper carton, does not provide any other significant utility.

Use of a paper carton to hold shells has several disadvantages to both shooters and reloaders. For example, when the paper carton filled with shells is placed in the shell pouch, the partially open flap interferes with access to the shells. Thus the shooter frequently either removes the opening flap completely, or folds the flap downward adjacent to one side of the carton. If the opening flap is removed, the box essentially loses its usefulness to reloaders. If the opening flap is folded back repeatedly, the flap, and the paper carton in general, wear out and become tattered.

From the foregoing, it will be appreciated that there is a need for a device that permits stacking and storing of shotgun shells in an improved manner. This and other objects and advantages of the invention will become more apparent from the following description taken in conjunction with the accompanying drawings.

SUMMARY OF THE INVENTION

The aforementioned needs are satisfied by an assembly for housing shotgun shells comprising a container having a floor. The floor has two side lateral edges and a front and a rear lateral edge. Two side walls are mounted at the side lateral edges of the floor and a rear wall is attached to the rear lateral edge of the floor so as to extend between the two side walls. The floor, the two side walls and the rear wall define a first recess. The container has a first opening formed adjacent the front lateral edge of the floor between the two side walls that is sized so as to permit shotgun shells to be positioned in the first recess via the first opening. The assembly further comprises a cover that defines a partially enclosed space that is sized to receive the container such that when the container is positioned within the partially enclosed space of the cover, the cover encloses the first opening of the container so as to prevent the shotgun shells positioned within the first recess from dislodging from the first recess.

In one embodiment, the cover comprises a front panel, a rear panel, and two side panels connected to four edges of a rectangular shaped base panel, such that the two side panels and the front and rear panels define an opening adjacent a plane located opposite from the base panel. Each of the two side panels defines a cutout adjacent the opening to facilitate grasping of the container positioned therein. In one implementation, the cutout is semicircular is shape and has a radius of approximately ⅝".

In one embodiment, the dimension of the opening of the cover is larger than the dimension of the base panel so as to facilitate insertion of the container into the partially enclosed space. To achieve such orientation, each of the front, rear, and two side panels in one embodiment of the cover is oriented with respect to the base panel so as to form an angle of approximately 0.5 degree with respect to the normal of the base panel such that the opening is larger than the base panel.

In one embodiment, the rear wall of the container comprises two rounded comers at locations opposite from the rear lateral edge of the floor. The rounded comers facilitate insertion of the container into the cover. Each of the two rounded comers has a radius of curvature of approximately 0.375".

In one embodiment, the height of the two side walls is selected to be less than the height of the rear wall. The height of the two side walls is selected such that the top of the two side walls is adjacent a height where the rounded corners of the rear wall end so as to permit the two side walls to be formed in a planar manner while being tall enough to retain the top layer of the shotgun shells positioned within the first recess. One possible height of the two side walls is approximately 3¾".

In one embodiment, the assembly further comprises a latching mechanism that latches the cover and the container together when the container is positioned within the cover. The latching mechanism is configured to permit removal of the container from the partially enclosed space of the cover. In one implementation, the latching mechanism comprises frictional engagement between the cover and container. The opening of the cover being larger than the base panel permits the container to be inserted into the cover frictionally engage when the container is near the fully inserted configuration.

In one embodiment, the exterior side of the floor of the container defines an area with a surface adapted to receive labels for identification purposes. In one embodiment, the container and the cover are formed from plastic with thickness of approximately 0.06". In one embodiment, the container and the cover are dimensioned to hold 25 12-gauge 2¾" shotgun shells in a 5×5 configuration.

Another aspect of the invention relates to an assembly for housing shotgun shells comprising a container having a floor. The floor has two side lateral edges and a front and a rear lateral edge. Two side walls are mounted at the side lateral edges of the floor and a rear wall is attached to the rear lateral edge of the floor so as to extend between the two side walls. The floor, the two side walls and the rear wall define a first recess. The container has a first opening formed adjacent the front lateral edge of the floor between the two side walls that is sized so as to permit shotgun shells to be positioned in the first recess via the first opening. The assembly further comprises a cover that defines a partially enclosed space that is sized to receive the container such that when the container is positioned within the partially enclosed space of the cover, the cover encloses the first opening of the container so as to prevent the shotgun shells positioned within the first recess from dislodging from the first recess. The assembly further comprises a stand adapted to detachably hold the container at a first orientation to facilitate positioning of the shotgun shells in the first recess of the container.

In one embodiment, the cover comprises a front panel, a rear panel, and two side panels connected to four edges of a rectangular shaped base panel, such that the two side panels and the front and rear panels define an opening adjacent a plane located opposite from the base panel. Each of the two side panels defines a cutout adjacent the opening to facilitate grasping of the container positioned therein. In one implementation, the cutout is semicircular is shape and has a radius of approximately ⅝.

In one embodiment, the dimension of the opening of cover is larger than the dimension of the base panel so as to facilitate insertion of the container into the partially enclosed space. To achieve such orientation, each of the front, rear, and two side panels is oriented with respect to the base panel so as to form an angle of approximately 0.5 degree with respect to the normal of the base panel such that the opening is larger than the base panel.

In one embodiment, the rear wall of the container comprises two rounded corners at locations opposite from the rear lateral edge of the floor. The rounded corners facilitate insertion of the container into the cover. Each of the two rounded corners has a radius of curvature of approximately 0.375".

In one embodiment, the height of the two side walls is selected to be less than the height of the rear wall. The height of the two side walls is selected such that the top of the two side walls is adjacent a height where the rounded comers of the rear wall end so as to permit the two side walls to be formed in a planar manner while being tall enough to retain the top layer of the shotgun shells positioned within the first recess. One possible height of the two side walls is approximately 3¾".

In one embodiment, the assembly further comprises a latching mechanism that latches the cover and the container together when the container is positioned within the cover. The latching mechanism is configured to permit removal of the container from the partially enclosed space of the cover. In one implementation, the latching mechanism comprises Frictional engagement between the cover and container. The opening of the cover being larger than the base panel permits the container to be inserted into the cover frictionally engage when the container is near the fully inserted configuration.

In one embodiment, the exterior side of the floor of the container defines an area with a surface adapted to receive labels for identification purposes. In one embodiment, the container and the cover are formed from plastic with thickness of approximately 0.06". In one embodiment, the container and the cover are dimensioned to hold 25 12-gauge 2¾" shotgun shells in a 5×5 configuration.

In one embodiment, the stand comprises a platform supported by a first and a second leg, and a rear and a side retaining wall to permit the container to be removably mounted. The first leg is longer than the second leg so as to orient the platform at a selected angle such that the container mounted thereon is biased towards the side retaining wall by gravity. The angled orientation of the container facilitates stacking of shells in the first recess. In one embodiment, the selected angle is approximately 25 degrees with respect to a supporting surface.

Another aspect of the invention relates to a method of storing shotgun shells in a housing assembly comprising a container adapted to hold a plurality of shotgun shells and a cover adapted to receive the container such that when the container is received by the cover the shells held by the container is inhibited from being dislodged from the container. The method comprises positioning the shotgun shells in the container and positioning the cover relative to the container such that the container is received by the cover so as to permit storage of shotgun shells in the cover and container assembly.

The method further comprises accessing the shotgun shells by removing the container from the cover so as to transfer the shotgun shells from the container to the cover thereby exposing the shotgun shells for access. Preferably, positioning the shotgun shells in the container comprises stacking the shells to form alternating orientations of the shells such that brass base of one shell is adjacent to crimped end of a neighboring shell. These and other objects and advantages of the invention will become more apparent from the following description taken in conjunction with the accompanying drawings.

DETAILED DESCRIPTION OF THE PREFERRED EMBODIMENT

Figure 1:
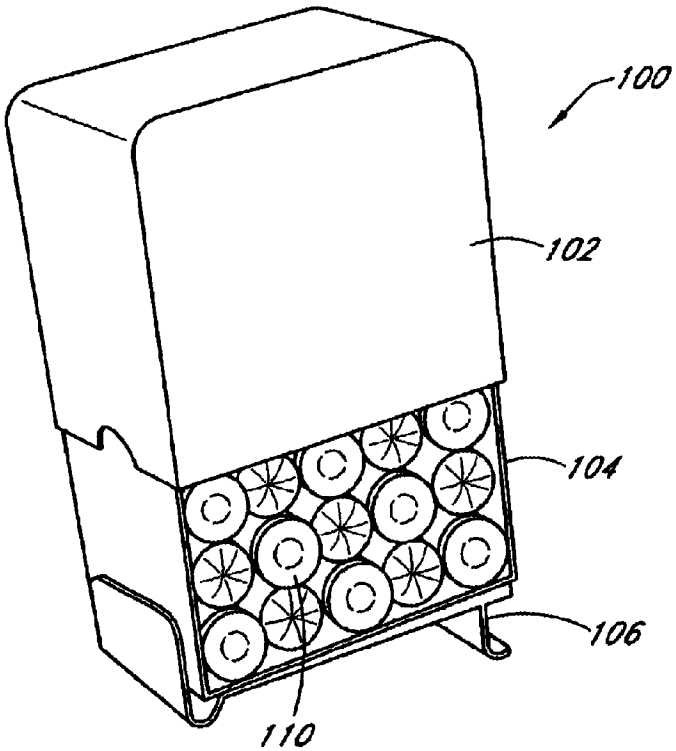
FIG. 1 illustrates a filled and partially covered shotgun shell housing assembly adapted to stack and hold shotgun shells.

Reference will now be made to the drawings wherein like numerals refer to like parts throughout. FIG. 1 illustrates a shotgun shell housing assembly 100 that advantageously permits a user to stack and hold shotgun shells according to various aspects and embodiments of the invention described below. The shotgun shell housing assembly 100 comprises a cover 102 and a container 104 adapted to be received by the cover 102. In one embodiment of the invention, the shotgun shell housing assembly 100 is used in conjunction with a stand 106 to permit stacking of shells in a manner described below.

FIG. 1 illustrates the shotgun shell housing assembly 100 filled with a plurality of shotgun shells 110, and in a partially covered configuration. In one embodiment of the invention, as shown in FIG. 1, the shotgun shell housing assembly 100 is dimensioned to allow the shells 110 to be stacked in a 5×5 configuration, substantially similar to the manner of packaging employed by many manufacturers. In particular, the dimensions of the components of the shotgun shell housing assembly 100 disclosed herein are adapted for standard 12-gauge 2¾" shells. It will be understood that such an adaptation represents one possible embodiment of the invention, and is not intended to limit the scope of the invention. The inventive features disclosed herein may be adapted for any number of types of shells, such as different length 12-gauge shells, different gauge shells, and combinations thereof. Furthermore, the 5×5 stacking configuration also represents one possible embodiment of the invention. The shotgun shell housing assembly of the invention may be adapted to accept any number of different stacking configuration without departing from the spirit of the invention.

Figure 2:
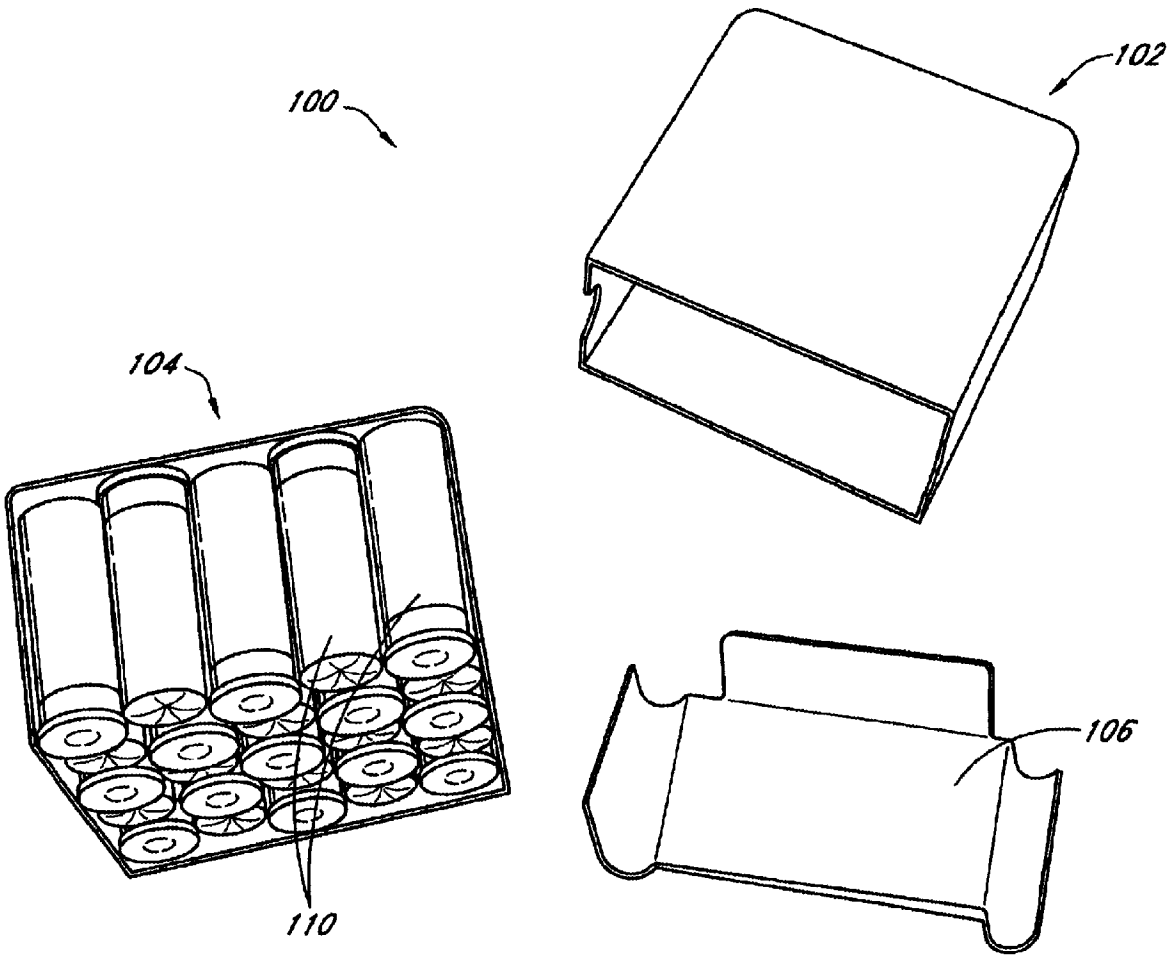
FIG. 2 illustrates separated components of the shotgun shell housing assembly of FIG. 1, comprising a cover, a container, and a stand.

FIG. 2 illustrates the components of the shotgun shell housing assembly 100 in an uncovered configuration. In particular, FIG. 2 shows that the container 104 advantageously separates from the stand 106 to form one distinguishing feature of the shotgun shell housing assembly 100 when compared to traditional devices, such as the shell stacking device referred to in the Description of the Related Art section. The advantages associated with separability of the container 104 and the stand 106 are described below. As will be described in greater detail below, the stand 106 is adapted to removably receive the container 104 such that the container 104 is oriented at a selected orientation to permit easier stacking of the shells.

Figure 3A:
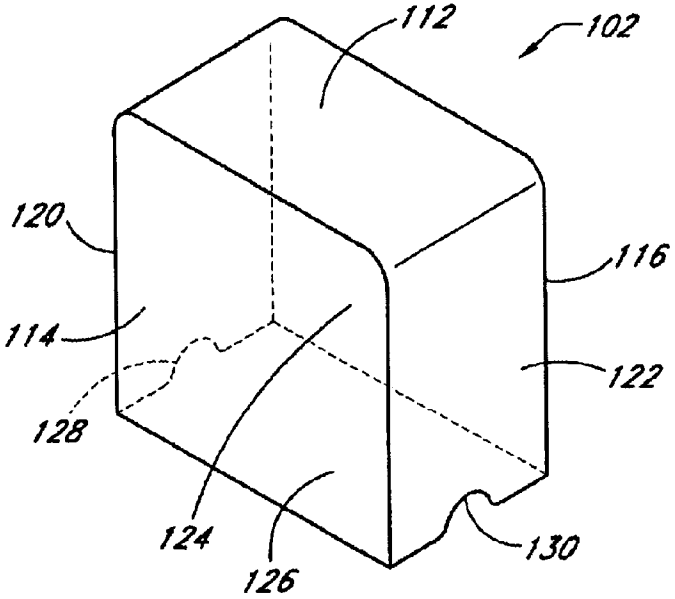
FIG. 3A illustrates a perspective view of the cover.
Figure 3B:
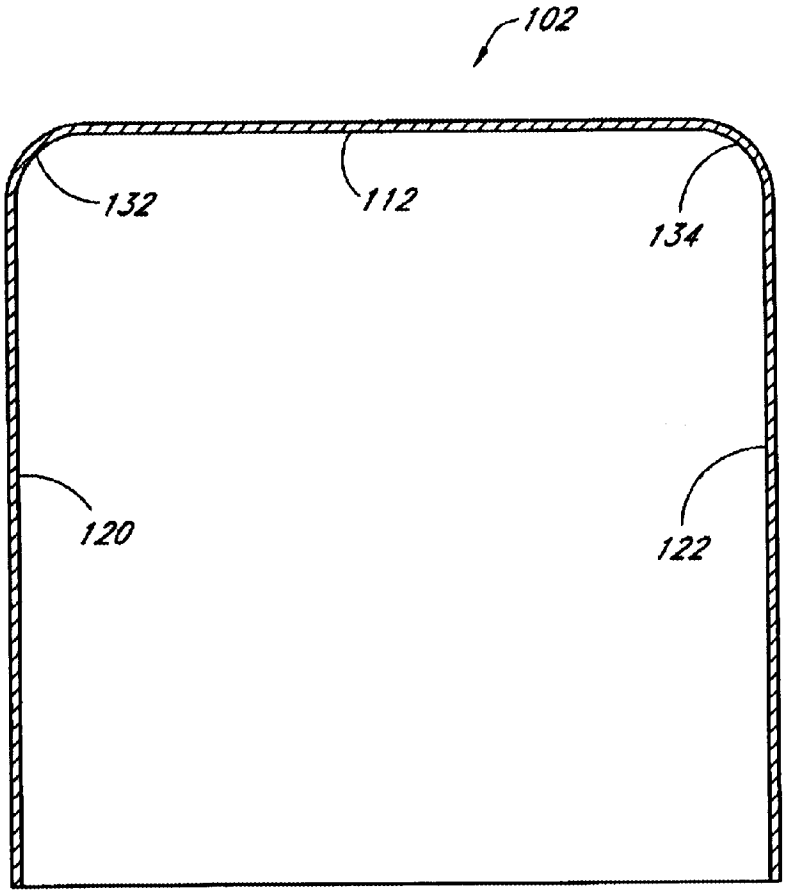
FIG. 3B illustrates a front view of the cover.

FIGS. 3A–B illustrate various views of the cover 102. As shown in FIG. 3A, the cover 102 comprises a planar base panel 112 that is generally rectangular so as to define four edges. A front panel 114 extends from a front edge of the base panel 112, and a rear panel 116 extends from a rear edge of the base panel 112. Similarly, a left panel 120 extends from a left edge of the base panel 112 and a right panel 122 extends from a right edge of the base panel 112. Thus, the base 112, front 114, rear 116, left 120, and right 122 panels collectively make up the cover 102 and define a partially enclosed space 124. Furthermore, first edges of the front 114, rear 116, left 120, and right 122 panels define an opening 126 adjacent a plane located substantially opposite from the base panel 112.

In one embodiment, as shown in FIG. 3A, the first edges of the left and right panels 120, 122 define cutouts 128, 130 respectively that permit the container 104 to be grasped and removed from the cover. In one embodiment, each of the cutouts is a semicircle with radius of approximately ⅝". The ends of the semicircle cutouts 128, 130 are rounded with respect to the first edges of the left and right panels 120, 122 so as to advantageously remove sharp comers.

In one embodiment, such as that illustrated in FIGS. 3A–B, the cover 102 is dimensioned such that the opening 126 is sized slightly larger than the base panel 112. Such configuration permits the container 104 to be easily inserted into the partially encloses space 124 of the cover 102 and be retained therein in a manner described below. In one embodiment, each of the front, rear, left, and right panels 114, 116, 120, 122 is oriented so as to form an angle of approximately 0.5 degree with respect the normal of the base panel 112.

FIG. 3B illustrates a front view of the cover 102. In particular, FIG. 3B illustrates a manner in which the base panel 112 is connected to the left and right panels 120 and 122 to form one embodiment of the invention. The left and right panels 120 and 122 are connected to the base panel 112 to form rounded comers 132 and 134 respectively. The rounded corners 132 and 134 are dimensioned to correspond to rounded portions of the container 104 described below, wherein the rounded portions of the container 104 further facilitates insertion of the container 104 into the partially enclosed space 124 of the cover 102. As will be described below, the rounded corners 132 and 134 facilitate insertion of the inverted cover 102 into a device dimensioned to receive factory shotgun shell paper cartons. In one embodiment, the radius of the rounded corners 132, 134 is approximately 0.375".

In one embodiment, the base panel has an overall external dimension of approximately 4.322"×2.498". Each of the front and rear panels 114 and 116 is dimensioned so as to have an overall external height of approximately 4.195". Each of the edges of the front and rear panels 114 and 116 adjacent the base panel 112 has an overall external dimension of approximately 4.322", and each of the first edges of the front and rear panels 114 and 116 adjacent the opening 126 has an overall external dimension of approximately 4.355". Similarly, each of the left and right panels 120 and 122 has an overall external height of approximately 4.195", and is dimensioned approximately 2.498" and 2.535" adjacent the base panel 112 and the opening 126 respectively. In one embodiment, the cover 102 is formed as a single piece from plastic, and has a panel thickness of approximately 0.06".

Figure 4A:
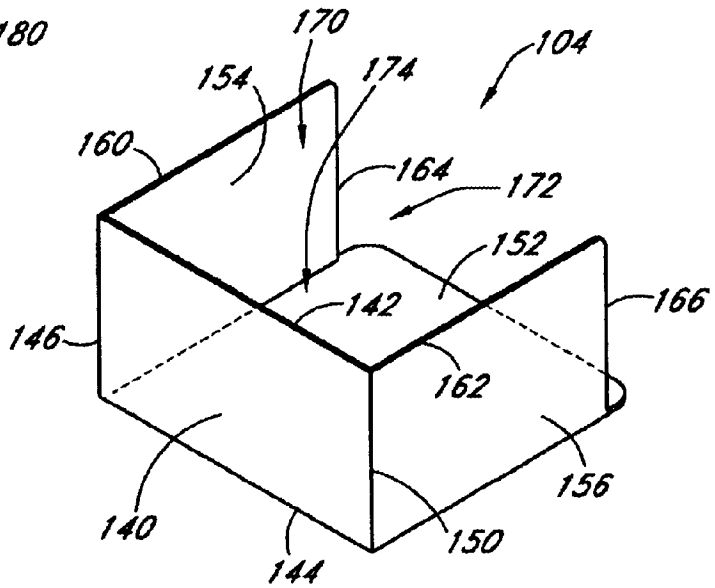
FIG. 4A illustrates a perspective view of the container.
Figure 4B:
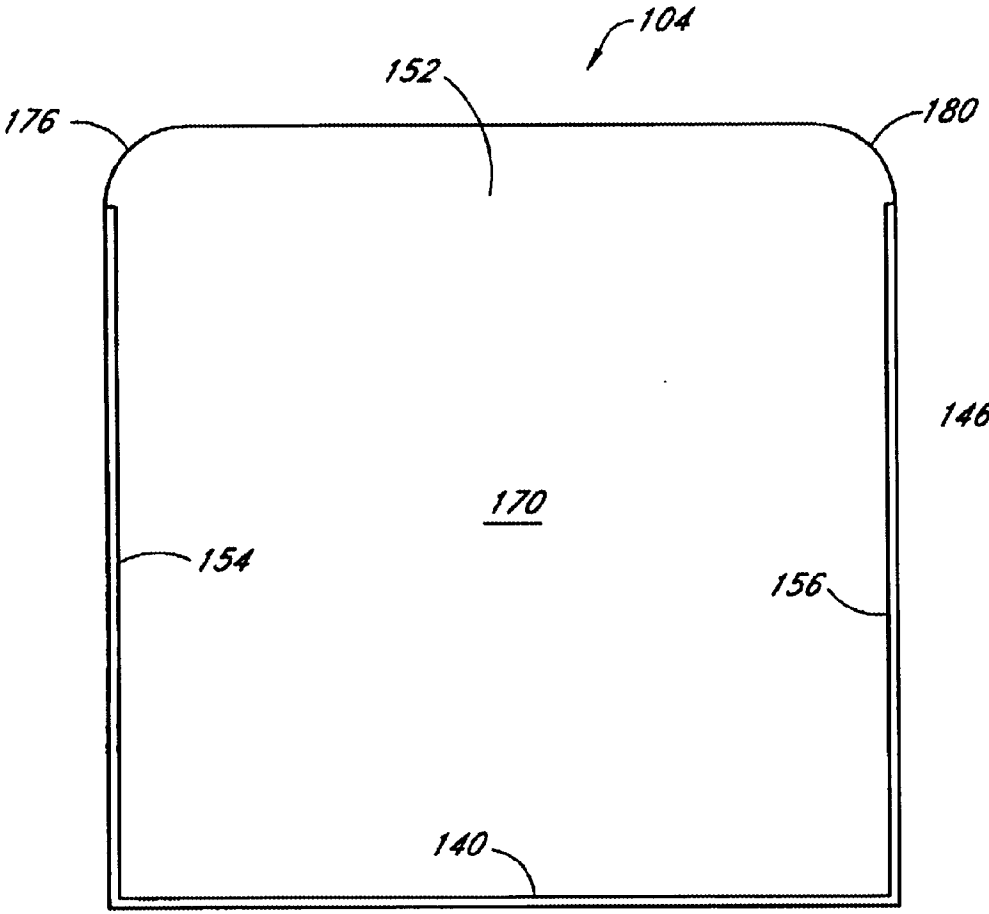
FIG. 4B illustrates a front view of the container.
Figure 4C:
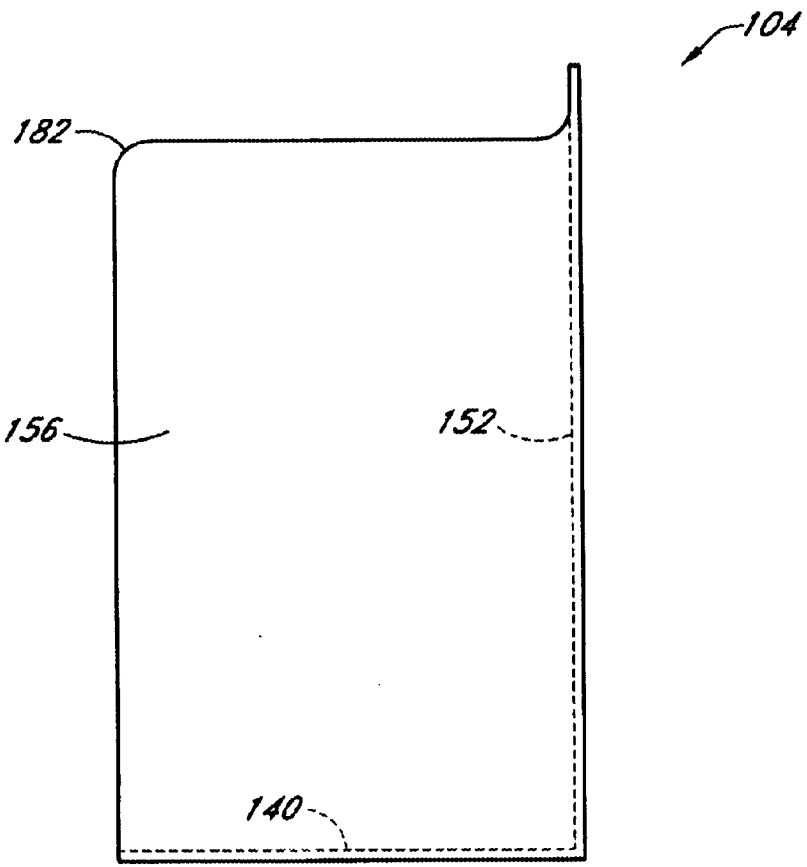
FIG. 4C illustrates a side view of the container.

FIGS. 4A–C illustrate the container 104 in one embodiment of the invention. As illustrated in FIG. 4A, the container 104 comprises a floor 140 having a front lateral edge 142, a rear lateral edge 144, a first side lateral edge 146, and a second side lateral edge 150 so as to define a rectangle. A rear wall 152 is attached to the rear lateral edge 144, and first and second side walls 154 and 156 are attached to the first and second side lateral edges 146 and 150 respectively. Thus, the floor 140, the rear wall 152, and the first and second side walls 154 and 156 collectively define a first recess 174. The front lateral edge 142 of the floor 140 and edges 160 and 162 of the first and second side walls extending therefrom further define a first opening 170 opposite from the rear wall 152 that permits shotgun shells to be stacked in the first recess 174 in a manner described below. Edges 164 and 166 of the first and second side walls 154 and 156 located on the opposite ends from the floor 140, further define a second opening 172 opposite from the floor 140 that permits the stacked shotgun shells to be transferred from the first recess 174 into the partially enclosed space 124 of the cover 102 (FIG. 3A) in a manner described below.

The container 104 generally defines a partially enclosed box-like volume with the floor 140, rear wall 152, and the first and second side walls 154 and 156 forming the boundaries as described above. The overall dimensions of the volume defined by the container 104 is selected so as to permit the container 104 to removably fit into the partially enclosed space 124 of the cover 102. In one embodiment, the rear wall 152 of the container 104 is dimensioned to fit inside the partially enclosed space 124 adjacent the rear panel 116. Furthermore, the rear wall 152 is dimensioned such that when fully inserted into the partially enclosed space 124, the floor 140 is adjacent to the opening 126 of the cover 102. Thus, the assembled combination of the cover 102 and the container 104 form an enclosed box, with the cover preventing the shells from being dislodged from the first recess of the container 104.

FIG. 4B illustrates a front view of the container 104, wherein the rear wall 152 is shown to comprise rounded corners 176 and 180 that advantageously permit the container 104 to be inserted into the enclosed space 124 of the cover 102. The rounded corners 176 and 180 are preferably dimensioned to match the rounded corners 132 and 134 (FIG. 3B) that interconnect the base panel 112 to the left and right panels respectively. Thus in one embodiment, each of the rounded comers 176 and 180 has a radius of approximately 0.375". The rear wall 152 is approximately 4¼" long along the edge adjacent to the floor 140, and approximately 4⁷⁄₃₂" long along the edge adjacent to the second opening 172. The rear wall 152 is approximately 4.195" high.

FIG. 4C illustrates a side view of the container 104 in one embodiment. In particular, the second side wall 156 (also applicable to the first wall 154 not shown) comprises a radiused comer 182 to facilitate insertion of the container 104 into the partially enclosed space 124 of the cover 102. Furthermore, the height of the first and second side walls 154 and 156 is selected so as to correspond to the height of the rear wall 152 at a location where its radiused comers 176 and 180 end. Such height of the first and second side walls 154 and 156 permit the side walls to retain the stacked shotgun shells sufficiently, while maintaining a generally flat configuration by not having to follow the contours of the rounded corners 176 and 180. Thus in one embodiment, each of the first and second side walls 154 and 156 has a height of approximately 3¾". Furthermore, each of the first and second side walls 154 and 156 is approximately 2¹⁵⁄₃₂" along the edge adjacent to the floor 140, and approximately 2⁷⁄₁₆" along the edge adjacent to the second opening 172. The radiused corner 182 has a radius of approximately ³⁄₁₆". In one embodiment, the container 104 is formed as a single piece from plastic and has a wall thickness of approximately 0.06".

It will be appreciated that the cover 102 described above in reference to FIGS. 3A and B is substantially symmetric about a plane interposed between the front and rear panels 114 and 116. As such, the container 104 may be inserted into the cover 102 such that the container's rear wall 152 can be adjacent to either the front panel 114 or the rear panel 116. This feature advantageously permits the cover 102 and the container 104 to be assembled in an easier manner.

In one embodiment, such as that described above, the cover 102 and the container 104 are dimensioned such that when the container 104 is near a fully inserted position into the partially enclosed space 124 of the cover 102, portions of the cover 102 and the container 104 engage with sufficient friction to form a latching mechanism. Such a frictional latching mechanism inhibits the container 104 from becoming dislodged from the cover 102 unintentionally. It will be appreciated that other latching mechanisms between the cover and the container may be adapted by one of ordinary skill in the art without departing from the spirit of the invention.

Figure 5:
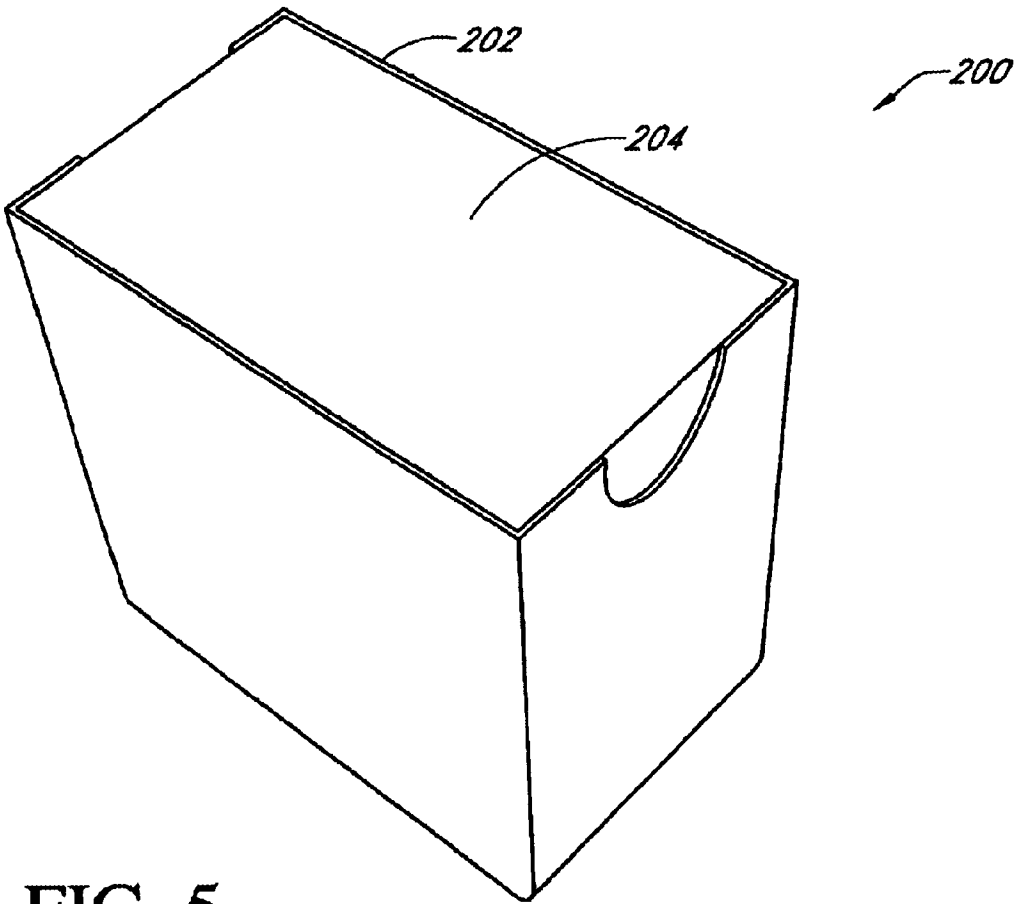
FIG. 5 illustrates the container and the cover assembled to form a box.

In one embodiment, the exterior surfaces of the cover 102 and the container 104 have a bead-blasted textured finish to provide a non-slip surface. As shown in the cover and container assembly 200 in FIG. 5 an exterior surface 202 of the floor of the container defines a smooth surface area 204 for labeling purpose, either by using a label or by marking directly with a marker such as a grease pen. It will be appreciated that other external surfaces of the container 104 or the cover 102 may include such labeling areas without departing from the spirit of the invention.

Figure 6:
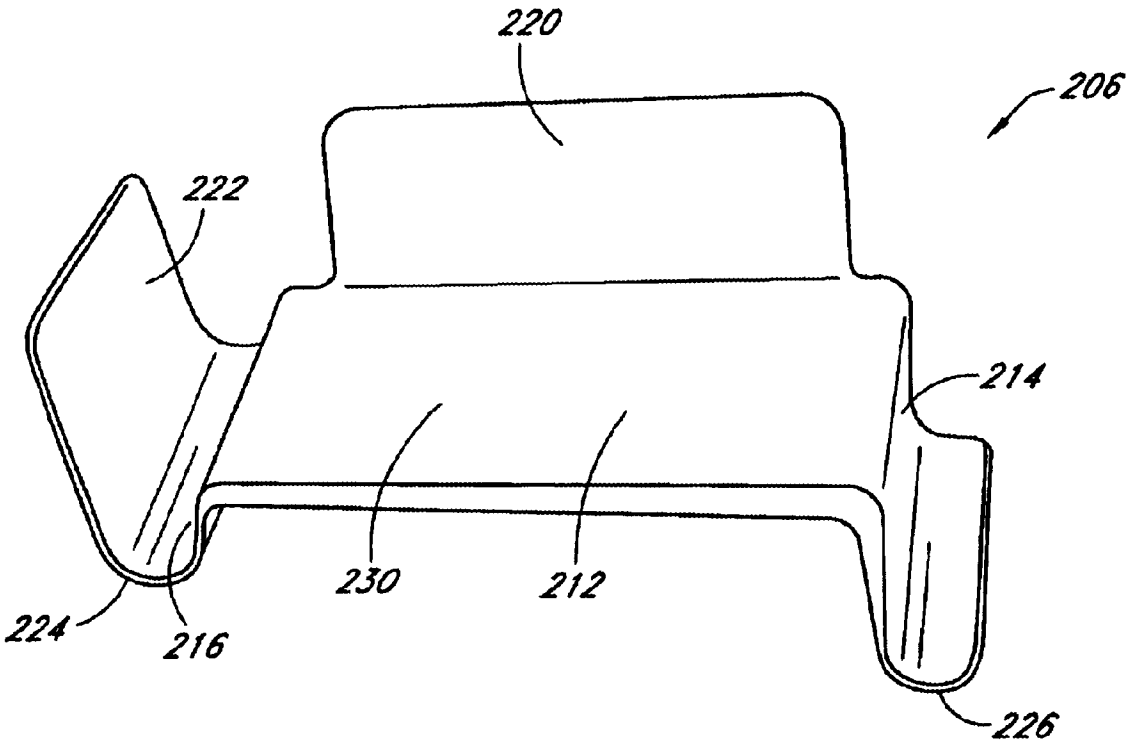
FIG. 6 illustrates the stand adapted to removably hold the container at an angle.

FIG. 6 illustrates the stand 106 referred to above in reference to FIGS. 1 and 2. The stand 106 permits the container 104 to be positioned at an angle that simplifies stacking of the shotgun shells in a manner described below. The stand 106 comprises a platform 212 supported by a first leg 214 and a second leg 216. The first leg 214 has a length that is greater than the second leg 216 so as to advantageously angle the platform 212 and the container 104 placed thereon.

The stand 106 further comprises a rear retaining wall 220 that extends upward from a location adjacent to the rear edge of the platform, and a side retaining wall 222 extends generally upward from a location adjacent to the second leg 216. When the container 104 is positioned on the stand, such as in FIG. 1, the exterior of the container 104 engages the stand such that the floor 140 is in engagement with the platform 212, the rear wall 152 is in engagement with the rear retaining wall 220, and one of the side walls 154, 156 is in engagement with the side retaining wall 222.

In one embodiment, the first leg 214 includes a rounded lip 226 that improves the manner in which the stand 106 engages a supporting surface. For example, the rounded lip 226 reduces likelihood of the first leg 214 from scratching or gouging the supporting surface, especially when the stand 106 supports heavy shells. The second leg 216 also includes a rounded bend 224 that further rounds upward to connect to the side retaining wall 222. The rounded bend 224 also advantageously reduces scratching and gouging of the supporting surface.

In one embodiment, the stand 106 is stamped from a single piece of sheet metal. The platform 212 has dimensions of approximately 3.5"×2". The rear retaining wall 220 has dimensions of approximately 2⅞"×1". The first leg 214 has a length such that the normal distance between the platform 212 and the contact area of the rounded lip 226 is approximately 1⅜". The second leg 216 has a length such that the normal distance between the platform 212 and the contact area of the rounded bend 224 is approximately ⅝".

The rounded bend 224 has a radius of approximately ¼", and the side retaining wall 222 extending therefrom extends above the platform by approximately ⅞", with the width of the side retaining wall 222 being substantially same as that of the platform 106 at approximately 2". The distance between the contact areas of the first and second legs is approximately 4". The geometry of the stand 106 thus yields the platform 212 being oriented at an angle of approximately 25 degrees with respect to the horizontal.

Figure 7:
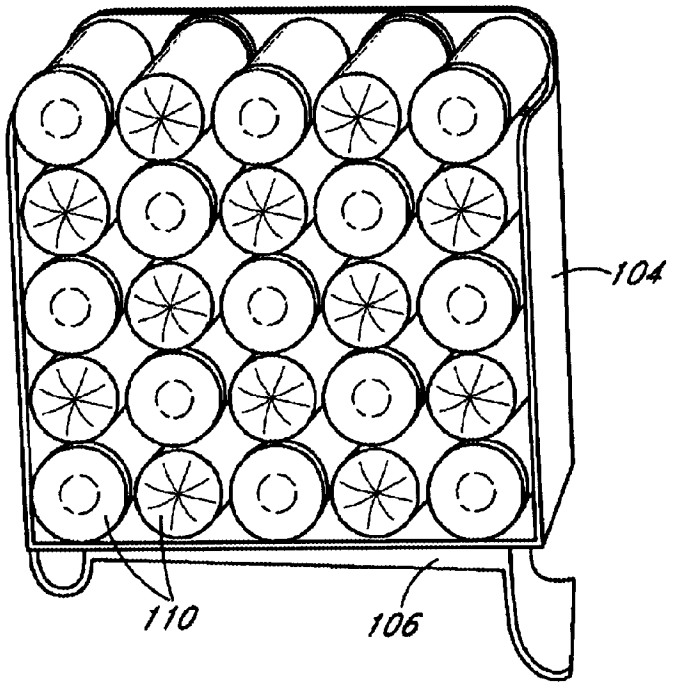
FIG. 7 illustrates the container mounted on the stand and filled with shotgun shells.

One aspect of the invention relates to a methods of stacking and storing shotgun shells using the components of the shotgun shell housing assembly described above. One method comprises stacking the shotgun shells in the first recess 174 of the container 104. FIG. 7 illustrates the container 104 positioned on the stand 106. The stacking process comprises positioning the shells 10 in the first recess 174 through the first opening 170 of the container 104. As is known in the art, alternating the orientation of the shells such that the rimmed brass base portion of one shell is adjacent to the crimped end of another neighboring shell permits the stacked shells to maintain an overall volume that conforms to box-like containers. Thus, the fully stacked shells in FIG. 7 are arranged accordingly, and larger diameter of the brass base rim is compensated for by neighboring shells' crimped ends.

As further illustrated in FIG. 7, the angled stand 106 permits the shells to be stacked from the lower left comer of the first recess 174. It will be appreciated, however, that the stacking of the shells into the container 104 may be performed without the use of the stand 106 without departing from the spirit of the invention. For example, the container 104 may be positioned on a flat surface such as a tabletop. Alternatively, the container 104 may be held by a hand, or may be supported in any number of ways without departing from the spirit of the invention.

Once the first recess 174 of the container 104 is filled with shells, the cover 102 is placed over the filled container 104, as illustrated in FIG. 1. When the container 104 fully enters the partially enclosed space 124 of the cover 102 (FIG. 3A) and latches to the cover 102, the shells in the first recess 174 of the container 104, now also in the partially enclosed space 124 of the cover 102, are retained in the shotgun shell housing assembly 100. The cover 102 and container 104 assembly may be positioned in any number of orientations while retaining the shells therein. Furthermore, the cover/container combination permits easy storage and carrying since the overall external dimensions are similar to that of a typical standard paper carton. It will be appreciated that such a cover/container configuration is permitted because the container, also acting as a stacking tray, is not permanently attached to the stand.

It will be appreciated that the cover/container assembly with shells therein can be received by products that are dimensioned to receive the paper carton filled with shells. For example, the belt-worn shell pouch referred to in the Description of the Related Art section can be loaded with the cover/container assembly of the invention such that the opening 126 (FIG. 3A) of the cover 102 faces upward. The rounded corners 132 and 134 of the cover 102 facilitates easy insertion of the cover/container assembly into the shell pouch. The container 104 is grasped at the first and second side walls 154, 156 through the cutouts 128 and 130, and pulled upward. The shells are transferred from the first recess 174 (FIG. 4A) of the container 104 to the partially enclosed space 124 of the cover 102 when the container 104 is removed. The cover 102 now functions in a manner similar to the paper carton with its lid either removed or folded back.

Although the preferred embodiment of the present invention has shown, described and pointed out the fundamental novel features of the invention as applied to this embodiment, it will be understood that various omissions, substitutions and changes in the form of the detail of the device illustrated may be made by those skilled in the art without departing from the spirit of the present invention. Consequently, the scope of the invention should not be limited to the foregoing description, but should be defined by the appending claims.

What is claimed is:

1. An assembly for housing shotgun shells having a generally cylindrical shape with a first and a second end, the assembly comprising:

a container having a floor having two side lateral edges and a front and a rear lateral edge, two side walls mounted at the side lateral edges of the floor and a rear wall attached to the rear lateral edge of the floor so as to extend between the two side walls wherein the floor, the two side walls and the rear wall define a first recess and wherein the container has a first opening formed adjacent the front lateral edge of the floor between the two side walls, and a second opening formed adjacent the first opening and opposite from the floor, wherein the first and second openings are sized so as to permit shotgun shells to be positioned in the first recess via the first or second opening and wherein the container is dimensioned so that the shotgun shells are arranged in a first orientation within the container so that the axes of the cylindrical shotgun shells extend in a direction substantially parallel to the direction of the two side walls;

a cover comprising a front panel, a rear panel, and two side panels attached to four edges of a base panel such that the two side panels and the front and rear panels define an opening adjacent a plane located opposite from the base panel such that the cover defines a partially enclosed space that is sized to receive the container wherein at least one dimension of the opening is larger than the corresponding dimension of the partially enclosed space adjacent the base panel wherein when the container is positioned within the partially enclosed space of the cover, the cover encloses the first and second openings in the container so as to prevent the shotgun shells positioned within the first recess from dislodging from the first recess; and wherein the cover and the container latch by frictional engagement when the container is near the fully inserted configuration wherein such frictional latching and the insertion of the container into the partially enclosed space of the cover are facilitated by the at least one dimension of the opening of the cover being larger than the corresponding dimension of the partially enclosed space adjacent the base panel and wherein the frictionally latched cover and container collectively define a housing that retains the shotgun shells in the first orientation until a user wishes to remove the shotgun shells.

2. The assembly of claim 1, wherein each of the two side panels defines a cutout adjacent the opening to facilitate grasping of the container positioned therein.

3. The assembly of claim 2, wherein the cutout is semicircular in shape.

4. The assembly of claim 3, wherein the semicircular cutout has a radius of approximately ⅝".

5. The assembly of claim 1, wherein each of the front, rear, and two side panels is oriented with respect to the base panel so as to form an angle of approximately 0.5 degree with respect to the normal of the base panel such that the opening is larger than the base panel.

6. The assembly of claim 1, wherein the exterior side of the floor of the container defines an area with a surface adapted to receive labels for identification purposes.

7. The assembly of claim 1, wherein the container and the cover are formed from plastic with thickness of approximately 0.06".

8. The assembly of claim 7, wherein the container and the cover are dimensioned to hold 25 12-gauge 2¾" shotgun shells in a 5×5 configuration.

9. An assembly for housing shotgun shells having a generally cylindrical shape with a first and a second end, the assembly comprising:

a container having a floor having two side lateral edges and a front and a rear lateral edge, two side walls mounted at the side lateral edges of the floor and a rear wall attached to the rear lateral edge of the floor so as to extend between the two side walls wherein the floor, the two side walls and the rear wall define a first recess and wherein the container has a first opening formed adjacent the front lateral edge of the floor between the two side walls, and a second opening formed adjacent the first opening and opposite from the floor, wherein the first and second openings are sized so as to permit shotgun shells to be positioned in the first recess via the first or second opening wherein the container is dimensioned so that the shotgun shells are arranged in a first orientation within the container so that the axes of the cylindrical shotgun shells extend in a direction substantially parallel to the direction of the two side walls;

a cover comprising a front panel, a rear panel, and two side panels attached to four edges of a base panel such that the two side panels and the front and rear panels define an opening adjacent a plane located opposite from the base panel such that the cover defines a partially enclosed space that is sized to receive the container wherein at least one dimension of the opening is larger than the corresponding dimension of the partially enclosed space adjacent the base panel wherein when the container is positioned within the partially enclosed space of the cover, the cover encloses the first and second openings in the container so as to prevent the shotgun shells positioned within the first recess from dislodging from the first recess, wherein the cover and the container latch by frictional engagement when the container is near the fully inserted configuration wherein such frictional latching and the insertion of the container into the partially enclosed space of the cover are facilitated by the at least one dimension of the opening of the cover being larger than the corresponding dimension of the partially enclosed space adjacent the base panel and wherein the frictionally latched cover and container collectively define a housing that retains the shotgun shells in the first orientation until a user wishes to remove the shotgun shells; and a stand adapted to detachably hold the container at a first container orientation to facilitate positioning of the shotgun shells in the first orientation in the first recess of the container.

10. The assembly of claim 9, wherein each of the two side panels defines a cutout adjacent the opening to facilitate grasping of the container positioned therein.

11. The assembly of claim 10, wherein the cutout is semicircular in shape.

12. The assembly of claim 11, wherein the semicircular cutout has a radius of approximately ⅝".

13. The assembly of claim 9, wherein each of the front, rear, and two side panels is oriented with respect to the base panel so as to form an angle of approximately 0.5 degree with respect to the normal of the base panel such that the opening is larger than the base panel.

14. The assembly of claim 9, wherein the exterior side of the floor of the container defines an area with a surface adapted to receive labels for identification purposes.

15. The assembly of claim 9, wherein the container and the cover are formed from plastic with thickness of approximately 0.06".

16. The assembly of claim 15, wherein the container and the cover are dimensioned to hold 25 12-gauge 2¾" shotgun shells in a 5×5 configuration.

17. The assembly of claim 9, wherein the stand comprises a platform supported by a first and a second leg, and a rear and a side retaining wall to permit the container to be removably mounted.

18. The assembly of claim 17, wherein the first leg is longer than the second leg so as to orient the platform at a selected angle, wherein the container mounted thereon is biased towards the side retaining wall by gravity, wherein the angled orientation of the container facilitates stacking of shells in the first recess.

19. The assembly of claim 18, wherein the selected angle is approximately 25 degrees with respect to a supporting surface.

20. The assembly of claim 1, wherein the height of the two side walls is selected to be less than the height of the rear wall.

21. The assembly of claim 20, wherein the rear wall defines non-sharp corners at ends of an edge opposite from the rear lateral edge of the floor, wherein the non-sharp corners facilitate the insertion of the rear wall into the partially enclosed space of the cover.

22. The assembly of claim 21, wherein the non-sharp corners comprise two rounded corners.

23. The assembly of claim 22, wherein each of the two rounded comers has a radius of curvature of approximately 0.375".

24. The assembly of claim 21, wherein the height of the two side walls is selected such that the top of the two side walls is adjacent a height where the non-sharp comers of the rear wall end so as to facilitate the insertion of the container into the cover while being tall enough to retain the top layer of shotgun shells positioned within the first recess.

25. The assembly of claim 24, wherein the height of the two side walls is approximately 3¾".

26. The assembly of claim 1, wherein the second opening of the container allows the retained shotgun shells to be transferred from the container to the cover by disengaging the container from the cover, wherein the shotgun shells substantially remain in the first orientation during the transfer.

27. The assembly of claim 26, wherein the transfer of the shotgun shells from the container to the cover is achieved by positioning the floor of the container upward relative to the second opening and pulling the container generally upward and removing the container from the partially enclosed space of the cover thereby allowing the shotgun shells to remain in the partially enclosed space of the cover.

28. The assembly of claim 9, wherein the height of the two side walls is selected to be less than the height of the rear wall.

29. The assembly of claim 28, wherein the rear wall defines non-sharp comers at ends of an edge opposite from the rear lateral edge of the floor, wherein the non-sharp comers facilitate the insertion of the rear wall into the partially enclosed space of the cover.

30. The assembly of claim 29, wherein the non-sharp comers comprise two rounded corners.

31. The assembly of claim 30, wherein each of the two rounded corners has a radius of curvature of approximately 0.375".

32. The assembly of claim 29, wherein the height of the two side walls is selected such that the top of the two side walls is adjacent a height where the non-sharp corners of the rear wall end so as to facilitate the insertion of the container into the cover while being tall enough to retain the top layer of shotgun shells positioned within the first recess.

33. The assembly of claim 32, wherein the height of the two side walls is approximately 3¾".

34. The assembly of claim 9, wherein the second opening of the container allows the retained shotgun shells to be transferred from the container to the cover by disengaging the container from the cover, wherein the shotgun shells substantially remain in the first orientation during the transfer.

35. The assembly of claim 34, wherein the transfer of the shotgun shells from the container to the cover is achieved by positioning the floor of the container upward relative to the second opening and pulling the container generally upward and removing the container from the partially enclosed space of the cover thereby allowing the shotgun shells to remain in the partially enclosed space of the cover.

* * * * *

UNITED STATES PATENT AND TRADEMARK OFFICE

CERTIFICATE OF CORRECTION

PATENT NO. : 6,779,654 B1
DATED : August 24, 2004
INVENTOR(S) : Ronald Richard Marquis It is certified that error appears in the above-identified patent and that said Letters Patent is hereby corrected as shown below:

Column 12,
Lines 40, 44 and 67, delete “comers” and insert -- corners --.

Column 13,
Lines 2 and 5, delete “comers” and insert -- corners --.

Signed and Sealed this

Twenty-first Day of March, 2006

JON W. DUDAS
*Director of the United States Patent and Trademark Office*

UNITED STATES PATENT AND TRADEMARK OFFICE

CERTIFICATE OF CORRECTION

PATENT NO. : 6,779,654 B1
APPLICATION NO. : 10/066406
DATED : August 24, 2004
INVENTOR(S) : Donald Richard Marquis It is certified that error appears in the above-identified patent and that said Letters Patent is hereby corrected as shown below:

Column 12,
Lines 40, 44 and 67, delete "comers" and insert -- corners --.

Column 13,
Lines 2 and 5, delete "comers" and insert -- corners --.

This certificate supersedes Certificate of Correction issued March 21, 2006.

Signed and Sealed this

Thirtieth Day of January, 2007

JON W. DUDAS
*Director of the United States Patent and Trademark Office*